United States Patent [19]

Angelini

[11] 4,176,015

[45] Nov. 27, 1979

[54] METHOD FOR CHROMIUM ELECTROPLATING OF BARS

[75] Inventor: Sergio Angelini, Milan, Italy

[73] Assignee: Fiat, S.p.A., Turin, Italy

[21] Appl. No.: 843,553

[22] Filed: Oct. 19, 1977

[30] Foreign Application Priority Data

Oct. 27, 1976 [IT] Italy ..... 28736 A/76

[51] Int. Cl.[2] ..... C25D 5/22; C25D 7/00

[52] U.S. Cl. ..... 204/28; 204/206

[58] Field of Search ..... 204/27, 28, DIG. 10, 204/209, 206

[56] References Cited

U.S. PATENT DOCUMENTS

| | | | |
|---|---|---|---|
| 907,425 | 12/1908 | Winkle et al. | 204/209 |
| 1,215,354 | 2/1917 | Eaton | 204/DIG. 10 |
| 1,473,060 | 11/1923 | Taylor | 204/DIG. 10 |
| 1,786,592 | 12/1930 | Baranowski | 204/DIG. 10 |
| 3,751,344 | 8/1973 | Angelini | 204/26 |

FOREIGN PATENT DOCUMENTS

| | | | |
|---|---|---|---|
| 18643 | of 1899 | United Kingdom | 204/224 R |

*Primary Examiner*—T. M. Tufariello

*Attorney, Agent, or Firm*—Fidelman, Wolffe & Waldron

[57] ABSTRACT

Method and apparatus for continuous chromium electroplating of bars; bars are mechanically and electrically connected in an uninterrupted row, which is rotated and advanced along a straight path through an anode immersed within an electroplating bath. The bar surfaces, in the course section crossing the electroplating anode, are brushed clean by means of a stationary brushing device, acting on rotations bars.

6 Claims, 6 Drawing Figures

METHOD FOR CHROMIUM ELECTROPLATING OF BARS

The present invention refers to a method and apparatus for chromium electroplating of bars and in particular is meant to attain an improvement aiming at a better process of electrodeposition of chromium itself.

Systems are known for continuous electroplating of outer surface of bars, no matter if solid or hollow, by which cylindrical bars are mechanically and electrically connected in an ininterrupted row, which is run through a tubular anode immersed within an electroplating bath.

In the systems formerly known a tendency subsists to the development on bars of a cathodic film, due to hydrogen ions, interfering with the plating current flow, and consequently hindering the electrodeposition of chromium.

The removal of such cathodic film would remarkably improve the plating process and the quality of the chromium layer on the bar surface; anyway the removal of such cathodic film, in the electroplating bath and particularly within the plating anode, becomes complicate, because of the difficulty to operate in the restricted space comprised between the surface of the bars to be plated and the inner surface of the plating anode itself; such difficulty is enhanced by the generally remarkable length of the plating anodes.

At present no system or method is known allowing to remove the cathodic film, in a continuous chromium plating process for bars or anything like that.

Therefore the purpose of the present invention is to furnish a method and an apparatus enabling to remove the cathodic film in a continuous electroplating process for bars or likes, in the portion of the path throughout the electroplating anode itself.

In general the problem is solved cleaning the bar surfaces by means of a continuous brushing or slightly scraping action, along at least one side of the bars, in the portion of the path throughout the electroplating anode.

Such brushing action is carried on along a generatrix line of bars by means of a stationary brushing device, taking advantage of the rotating movement transmitted to the bar row while it is moving forth.

Preferably such brushing device consists of a blade radially crossing the anode and getting in contact with the bar surface along a generatrix line of that surface, at least throughout the length of the electroplating anode.

In an embodiment of the invention, the above mentioned brushing blade consists of a layer of glass fiber or the like scraping material, compresed between side plates, made of acid resistant material, from which the glass fibers just protrude as much as necessary to touch the surface of the bars to be polished.

The invention will be better illustrated and described hereunder, with reference to the figures of the drawings attached, where:

Figure 1:
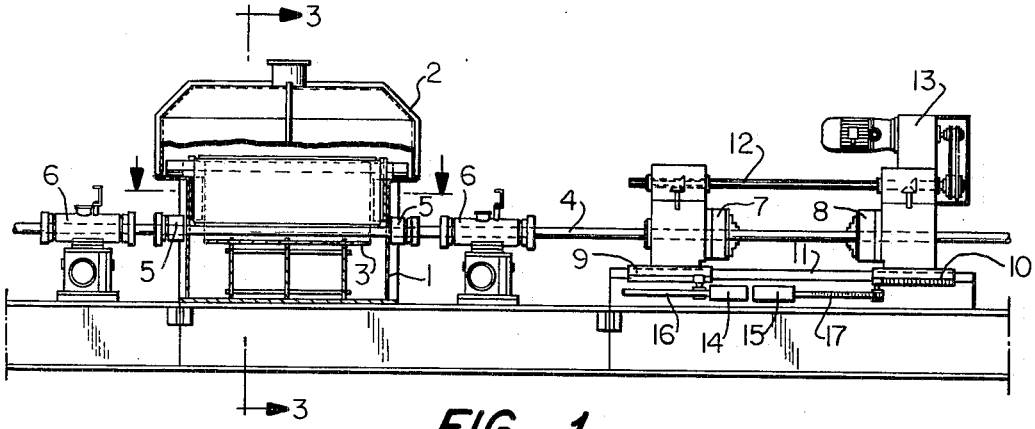
FIG. 1 is a part section side view of a chromium electroplating plant for bars, applying the principles of the present invention.
Figure 2:
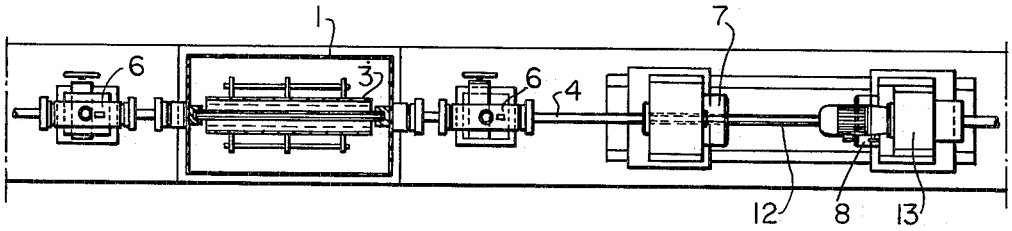
FIG. 2 is a part cutaway top view of the plant shown in FIG. 1.
Figure 3:
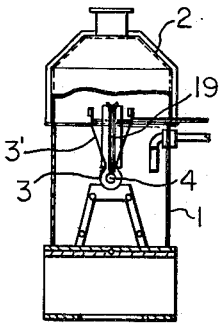
FIG. 3 is a cross section along line 3—3 of FIG. 1 through the electroplating bath tank.

With reference now to the only FIGS. 1 to 3 of the drawings attached, we are going to describe the essential features of a continuous chromium electroplating plant for cylindrical bars, improved in accordance with the present invention.

Essentially the plant includes a tank 1, containing a chromium plating bath, which is topped by a fume tight exhaustion hood 2.

Tank 1 contains a chromium electroplating bath, where anode 3 is immersed. Such anode is passed through uninterruptedly by bars 4 to be chromium plated. Bars 4 are mechanically and electrically connected to one another, thus constituting an ininterrupted row of bars. Seals 5 are located on the two end walls of tank 1, to prevent the plating solution from seeping out of the tank wall openings, which bars run through. The plating electric current is fed to the bar row by means of sliding contact devices 6, shown schematically on both ends of the tank 1. These known features of the chromium electroplating plant are not described in more details since they are no essential part of this invention.

The longitudinal movement of the bar row and the rotation around its own axis can be obtained, for example, by means of the feeding and rotating device shown in FIGS. 1 and 2.

Such feeding and rotating device, which is not to be understood as a limitation to the present invention, is substantially composed by two self centering rotating chucks 7 and 8, acting alternatively to tow and rotate the bar row 4. Each chuck is carried by a slide 9 and 10 respectively, which slides on guides 11 lined up with bath tank 1. Mechanical or hydraulic drives are used to move slides 9 and 10 along guides 11 to continuously advance bar row 4. Self centering chucks 7 and 8 are rotated uninterruptedly by driving splined shaft 12 which in turn is driven by reduction unit 13.

In the case shown in FIGS. 1 and 2, the drive of slides 9 and 10 supporting the self centering rotating chucks is obtained by means of hydraulic-pneumatic cylinders 14 and respectively 15 which, through racks 16 and 17, causes the reciprocal approaching and respectively moving away of the two chuck carrying slides.

Therefore one of the self centering chucks is connected with bar 4 and is towing and rotating it (for example during the approaching movement of chucks) while the other self centering chuck is disconnected from the bars. On the contrary, during the reverse movement of the self centering chucks, the chuck which was formerly driving the bars is now disengaged from them, while the other chuck drives in turn to the bar row, advancing and rotating it.

Figure 4:
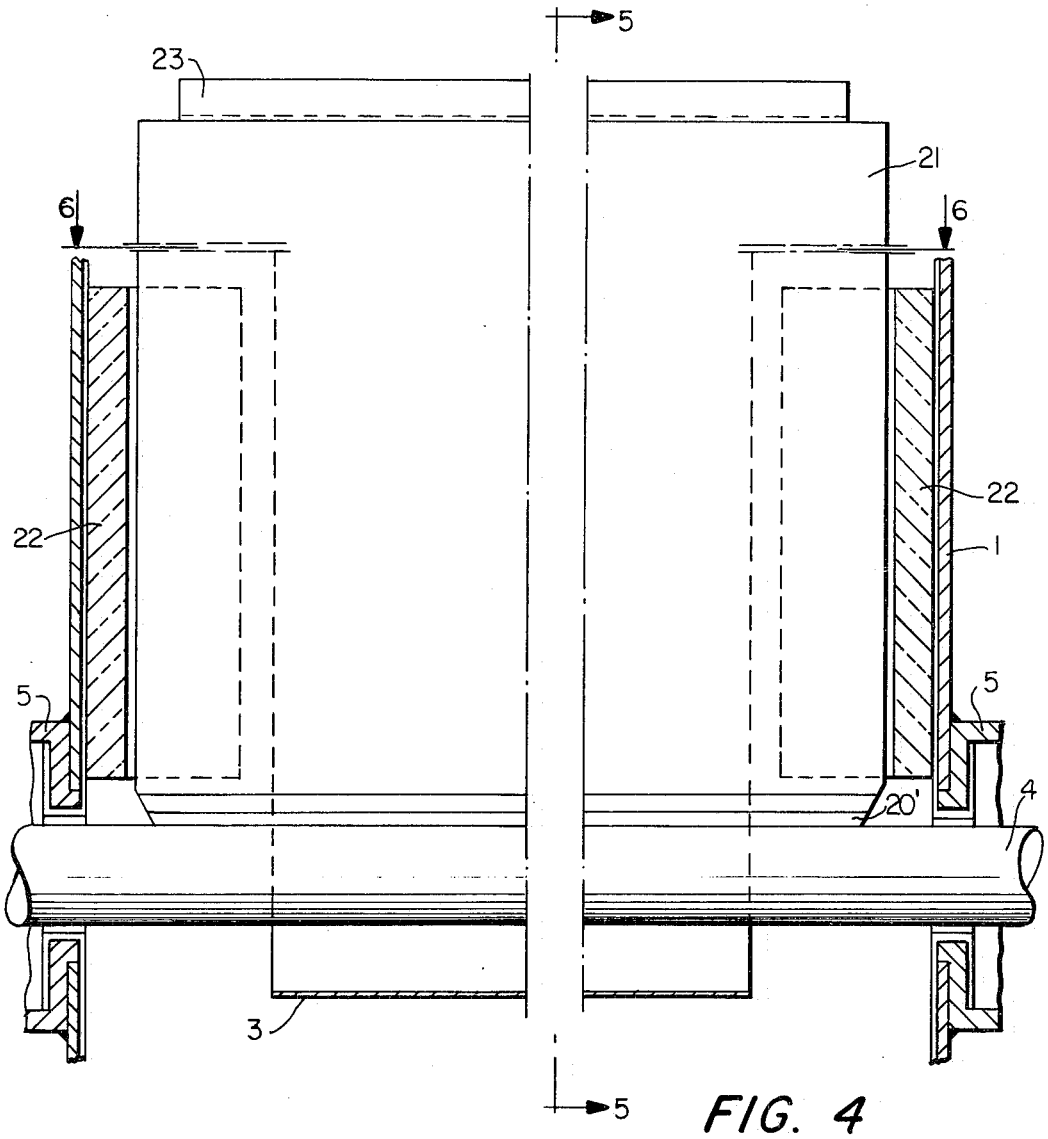
FIG. 4 is an enlarged side view, partially sectioned, through an electroplating bath tank to show better the details.
Figure 5:
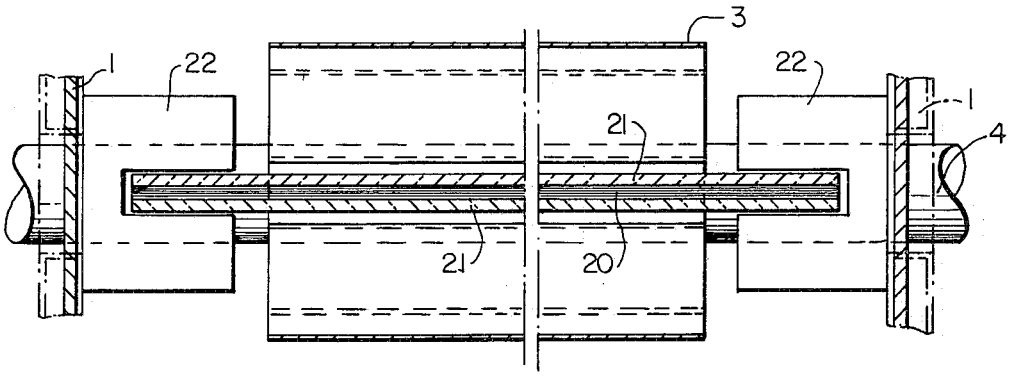
FIG. 5 is a cross section along line 5—5 of FIG. 4.
Figure 6:
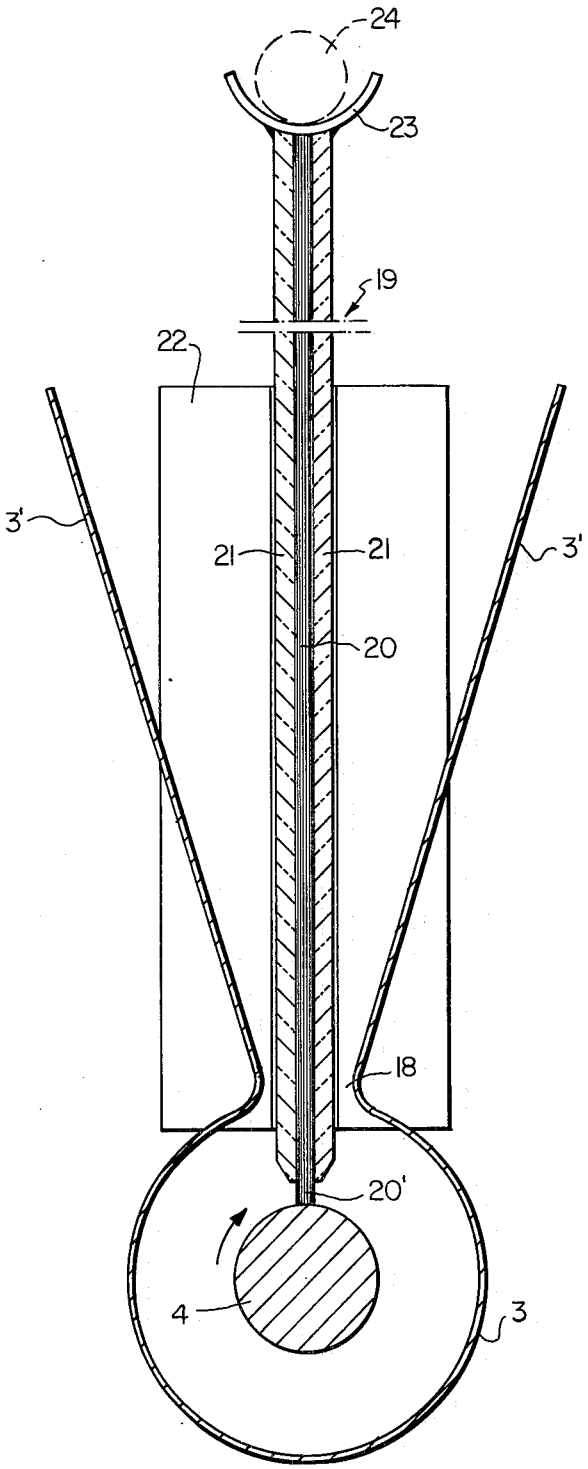
FIG. 6 is a longitudinal section along line 6—6 of FIG. 4.

With reference to FIG. 3 and particularly to FIGS. 4 5 and 6 of the attached drawings, one can notice that anode 3 does not encircle completely the section of bar row 4, but leaves a longitudinal opening 18, which is parallel to a generatrix of the bar surface. Therefore anode 3 extends on both sides with wings 3', which the plating current input terminals are connected to.

As above specified, during the plating process of bar row 4, within tank 1 and particularly along the whole length of anode 3, the hydrogen ions which develop in the bath have a tendency to adhere to the bar surface, developing a cathodic film with the aspect of a greasy layer, which is difficult to remove and hinders the regular deposition of chromium.

Consequently the present invention has provided for the cleaning of the bar surface, at least in the portion of the path included within anode 3, by means of a continuous brushing action. Such brushing action is obtained by means of a brushing device 19, which penetrates within anode 3, through its longitudinal opening 18. More details are given hereunder with reference to the example of FIGS. 4, 5 and 6 in the drawings attached.

Referring to the above mentioned figures, it can be noticed that the brushing device substantially consists of a blade 19 radially penetrating into the anode 3 from above through opening 18. Blade 19 consists of a layer 20 of glass fibers or of glass silk or other equivalent material. Such fibers are pressed and for instance, they may be glued between two supporting side plates 21, made of acid resistant material such as polyvinyl chloride, to provide the glass fiber layer 20 with the necessary stiffness.

The glass fiber layer 20 stands out slightly along the lower edge of plates 21, just as indicated by 20', touching with appropriate pressure the outer surface of bars 4, along a generatrix line of the latter.

The blade unit 19, constituting the cleaning device of bars 4, is guided on its sides in vertical guides 22, which are fixed, for instance, inside the end walls of tank 1, as indicated in the views of FIGS. 4 and 6 of the drawings attached.

As it may be understood from what has been stated and illustrated above, the pressure applied by the protruding portion 20' of the fiber layer, on the outer surface of bars 4, is mainly due to the own weight of blade 19. Anyway, it may be opportune, under special circumstances, to be able to adjust or to modify the intensity of such brushing pressure; for example, due to the fact that the protruding portion 20' of fiber layer 20 gradually wears and that it must be replaced over and over, removing the lower longitudinal edges of supporting plates 21, there is a consequent reduction in the weight of blade 19. Therefore, to keep a constant pressure applied by the fibers on the surface to be cleaned of bar 4, blade 19 is equipped at its top with a cradle 23, which weights 24 can be placed on, as indicated by dashed lines. This way the fiber pressure on the bar surface can be adjusted.

The operation of the apparatus for carrying out the method in accordance with the present invention appears to be fundamentally as follows: as stated above with reference to FIGS. 1 to 3, the row of bars 4 is advanced and rotated at the same time around its own longitudinal axis, as shown e.g. by the arrow of FIG. 5.

Consequently, this rotation applied to the bar row 4, is taken advantage of, to perform the brushing action and the ensuing cleaning of bar surface during the plating process.

According to the invention, the brushing and consequently cleaning action of the bars should preferably take place also beyond the ends of anode 3, so as to get the bar surface look clean both before and after the anode ends in the tank 1.

The performance of actual tests has demonstrated that the cleaning action of the bar row surface, inside the electroplating anode 3, not only improves the quality of the chromium layer deposited, which is an important factor in the case of hard plating, but also its quantity, thus boosting the productivity of the plant.

What stated and shown with reference to the figures of the drawings attached, is meant to be given only as an embodiment of the invention which eventually consists of a cleaning of the bar surface, performed by means of brushing action throughout the portion of the bar path, passing trough the chromium electroplating anode.

What is claimed is:

1. A method for electroplating metal bars which comprises:

mechanically and electrically connecting said bars to form an uninterrupted row, immersing in an electroplating bath an anode means adapted to substantially surround at least a portion of a bar while being spaced therefrom, said anode means having a longitudinal slot therein, mounting a stationary brush means in said slot adapted to contact a bar in the anode means, passing the bars through the anode means in a straight path while rotating the bars about their longitudinal axes, and concurrently slideably forcing said stationary brush means against the bar, whereby the bar surface is continuously cleaned by a brushing action during electroplating.

2. The method of claim 1 wherein the brushing action is performed along the generatrix of a bar surface within the anode means.

3. The method of claim 1 wherein a constant pressure is applied to the brush means.

4. The method of claim 2 wherein the brush means is forced against the bar surface in a radial direction.

5. The method of claim 1 wherein the electroplating bath is a chromium electroplating bath and the anode is a chromium electroplating anode.

6. The method of claim 4 wherein the brushing action by the brush means extends beyond the ends of the anode means.

* * * * *